US006868901B2

(12) United States Patent
Mason et al.

(10) Patent No.: US 6,868,901 B2
(45) Date of Patent: Mar. 22, 2005

(54) TUBULAR CUTTING TOOL

(75) Inventors: Guy Harvey Mason, Hampshire (GB); William Peter Stuart-Bruges, Hampshire (GB); Thomas Lempriere Searight, London (GB); Philip Anton Strong, Devon (GB); Timothy George Boxell, Hampshire (GB); Michael Andrew Yuratich, Hampshire (GB); Alan Thomas Fraser, Berkshire (GB)

(73) Assignee: Sondex Limited, Bramhill (GB)

( * ) Notice: Subject to any disclaimer, the term of this patent is extended or adjusted under 35 U.S.C. 154(b) by 0 days.

(21) Appl. No.: 10/096,362

(22) Filed: Mar. 12, 2002

(65) Prior Publication Data

US 2002/0150436 A1 Oct. 17, 2002

(30) Foreign Application Priority Data

Mar. 13, 2001 (GB) ..... 0106149

(51) Int. Cl.[7] ..... E21B 29/00
(52) U.S. Cl. ..... 166/55.7; 166/66.4
(58) Field of Search ..... 166/298, 55, 55.1, 166/55.7, 55.8, 66.4

(56) References Cited

U.S. PATENT DOCUMENTS

| | | | | |
|---|---|---|---|---|
| 1,358,818 A | | 11/1920 | Bering | |
| 2,280,769 A | | 4/1942 | Page | |
| 3,859,877 A | | 1/1975 | Sherer et al. | |
| 4,125,013 A | | 11/1978 | Nicolas et al. | |
| 4,125,161 A | | 11/1978 | Chammas | |
| 4,842,082 A | | 6/1989 | Springer | |
| 4,856,938 A | * | 8/1989 | Kuehn | 405/227 |
| 5,129,322 A | | 7/1992 | Christopher et al. | |
| 5,328,180 A | | 7/1994 | Benavides et al. | |
| 5,368,423 A | * | 11/1994 | Hanna | 409/132 |
| 5,431,230 A | * | 7/1995 | Land et al. | 166/369 |
| 5,492,436 A | * | 2/1996 | Suksumake | 405/201 |
| 6,026,911 A | | 2/2000 | Angle et al. | |
| 6,386,797 B1 | * | 5/2002 | Gearhart | 405/184.3 |

FOREIGN PATENT DOCUMENTS

| | | |
|---|---|---|
| EP | 0 266 864 | 5/1988 |
| GB | 1 601 260 | 10/1981 |

* cited by examiner

*Primary Examiner*—William Neuder
(74) *Attorney, Agent, or Firm*—Flynn, Thiel, Boutell & Tanis, P.C.

(57) ABSTRACT

A tubular cutting tool includes two or more sets of electrically actuated retractable anchoring legs mounted at longitudinally spaced apart locations and an electrically driven rotary cutting head with a retractable cutting blade. The anchoring legs can be arranged such that they are capable of compensating for variations in the internal radii of the tubular to be cut, thereby ensuring that the cutting tool is clamped rigidly in position.

28 Claims, 6 Drawing Sheets

TUBULAR CUTTING TOOL

BACKGROUND OF THE INVENTION

This invention relates to a tubular cutting tool, namely a device for remotely cutting tubulars, such as well casings, drill pipes and underwater or buried pipes, from the inside, using an electrically driven cutting head.

During certain phases of well drilling and development it is necessary to recover metal tubulars, or sections thereof, from the borehole. In order to achieve this, a device must be lowered inside the tubular, then operated remotely to perform a cut. The devices commonly employed in the art for this purpose can be largely divided into two categories.

The first category encompasses explosive or "chemical cutting" devices which are deployed on a cable, wireline or electric line. Examples of such devices are described in U.S. Pat. Nos. 5,129,322 and 4,125,161. These devices suffer from logistical and operational difficulties and impediments arising from the additional safety precautions required when utilising explosives and corrosive chemicals.

The second category consists of mechanical or hydraulic cutting devices which are deployed on the end of drill pipe, coiled tubing or other tubular; examples of such cutting devices are to be found in European Patent Application No. 0 266 864 and U.S. Pat. No. 3,859,877. Such devices suffer from the disadvantage of being cumbersome, as well as expensive to purchase, deploy and operate; the operation and deployment of the devices commonly requires a complete drill rig. Furthermore, in situations where the tubular to be cut is narrow employment of devices in this category may be precluded. Typically, devices in this category incorporate a number of large blades which gouge their way through the tubular. Gouging a cut through the tubular, rather than performing a precision cut, suffers from the disadvantage of requiring a large amount of energy as well as producing long "apple peel" spirals of metal which can fall into the tubular and hinder the cutting operation as well as future operations on the cut tubular.

In general, even tubular cutting tools incorporating more than one blade to perform a precision cut, rather than gouging a cut, suffer from the disadvantage that multiple blades have a tendency to "skip" in and out of the individual cuts they produce, resulting in an increased propensity for the blades to snap; in a single bladed tool, the single cutting blade runs around the wall of the tubular in its own cut, even in a slight eccentric or angled deployment.

In addition to the disadvantages already discussed, devices in both categories typically leave the cut end of the tubular in a ragged condition, which can occlude subsequent operations involving the tubular. Furthermore, those devices in both categories which include a mechanism for anchoring the device within a tubular, typically utilise some form of hydraulic or pneumatic means for part of the deployment of that mechanism. The use of hydraulic and/or pneumatic means results in the devices requiring multiple cables/hoses which can lead to additional deployment problems when the device is to be used in a tubular, for example, a live oil well, having a seal and airlock mechanism and/or when a cut is to be made at great depth.

SUMMARY OF THE INVENTION

According to the present invention there is provided a tubular cutting tool for remotely cutting tubulars from the inside, comprising: a housing; two or more sets of retractable anchoring means mounted in the housing at longitudinally spaced apart locations, adapted to be advanced from an initial retracted position out of contact with the internal wall of a tubular to be cut to an anchoring position in contact with the internal wall of the tubular, such as to anchor the tubular cutting tool rigidly in position within the tubular, and to be subsequently retracted from the anchoring position back to the retracted position; first electrically powered or controlled actuating means mounted in the housing and coupled to the retractable anchoring means for moving the retractable anchoring means from the retracted position to the anchoring position prior to performing a cut and then for moving the retractable anchoring means from the anchoring position back to the retracted position once a cut has been performed; a rotary cutting head mounted on the housing, the rotary cutting head having a retractable cutting blade adapted to be progressively advanced from an initial retracted position out of contact with the internal wall of the tubular to a cutting position in contact with the internal wall of the tubular, and to be subsequently retracted from the cutting position back to the retracted position out of contact with the internal wall of the tubular once a cut has been performed; second electrically powered or controlled actuating means mounted in the housing coupled to the retractable cutting blade for progressively advancing the cutting blade from the initial retracted position out of contact with the internal wall of the tubular towards the internal wall of the tubular and for subsequently progressively retracting the cutting blade back to the retracted position out of contact with the internal wall of the tubular once a cut has been performed; and third electrically powered or controlled actuating means mounted in the housing and coupled to the rotary cutting head for rotating the rotary cutting head. Advantageous features of the invention are set forth in the dependent claims to which reference should now be made.

A preferred embodiment of the invention for use in remotely cutting tubulars from the inside is described below in more detail with reference to the drawings.

According to the preferred embodiment of the invention, there is provided a tubular cutting tool with a cylindrical housing having an upper housing portion or section and a lower housing portion or section. The upper housing section contains support circuitry, a first electric motor, a first gearbox and a ball screw. An interface electronics cartridge and a deployment cable, for lowering or pushing the tool into a tubular, are attached to the end of the upper housing section distant to the lower housing section. The lower housing section contains support circuitry, a central shaft, a mechanical anchoring arrangement mounted around the central shaft, actuating means coupled to the mechanical anchoring arrangement and the central shaft, a second electric motor and a second gearbox. The mechanical anchoring arrangement comprises a set of retractable upper and lower achoring legs and a resilient material. The first electric motor, first gearbox, ball screw, central shaft and actuating means are operable to radially advance the retractable upper and lower anchoring legs from an initial retracted position out of contact with the internal wall of a tubular to an anchoring position in contact with the internal wall of the tubular. As the anchoring legs are radially advanced from the retracted position to the anchoring position the resilient material is compressed, so that the upper and lower anchoring legs are advanced to different radii while maintaining a similar force on the internal wall of the tubular.

An electrically driven rotary cutting head having a retractable cutting blade is mounted on the end of the lower housing section distant from the upper housing section. The second electric motor and the second gearbox contained in the lower housing section are coupled to the electrically driven rotary cutting head and are operable to rotate the cutting head and thereby radially advance the cutting blade from an initial retracted position out of contact with the internal wall of the tubular to a cutting position in contact with the internal wall of the tubular. The electrically driven rotary cutting head is designed so that the cutting blade is radially advanced in predetermined increments for each rotation of the cutting head.

The upper housing section is locked to the lower housing section, and the lower housing section is locked to the electrically driven rotary cutting head, by weakened linking pins. The weakened linking pins are designed to break under a shearing or tensional force, enabling the majority of the preferred embodiment of the tubular cutting tool according to the invention to be recovered from the inside of the tubular, in the event that either the anchoring mechanism and/or the rotary cutting mechanism should fail or jam, by pulling or winching on the deployment cable.

The present invention overcomes the difficulties encountered in the prior art by providing a tubular cutting tool which can be deployed on a single cable with a small crane and winch unit to produce a clean cut end, reminiscent of a machined edge, by incorporating both an electrically actuated anchoring mechanism capable of compensating for variations in the internal radii of the tubular to be cut, thereby ensuring that the cutting tool device is clamped rigidly in position, and an electrically driven rotary cutting head having a single, small sharp cutting blade.

BRIEF DESCRIPTION OF THE DRAWINGS

The invention will now be described in more detail, by way of example, with reference to the accompanying drawings in which.

DETAILED DESCRIPTION OF THE PREFERRED EMBODIMENT

Figure 1:
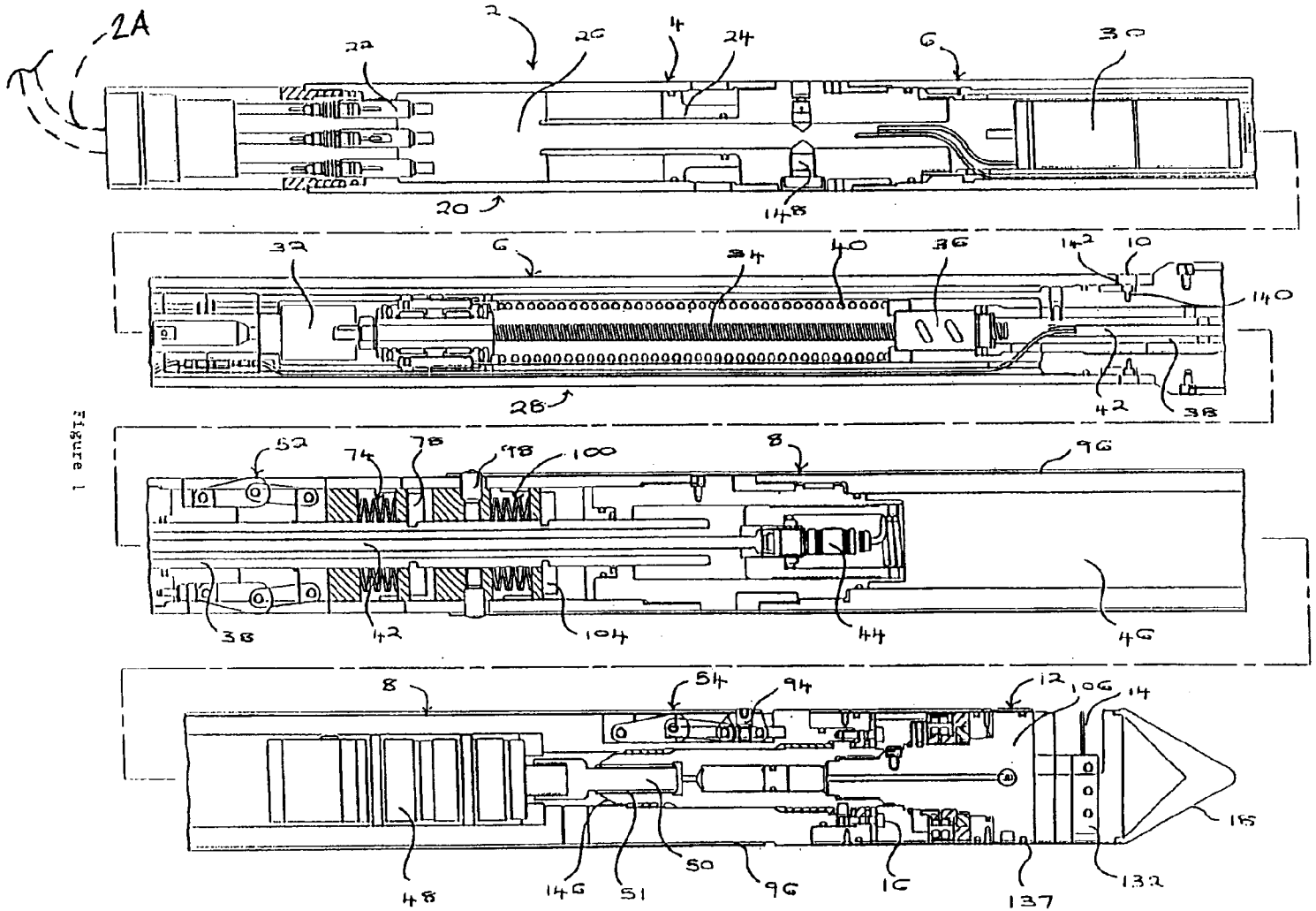
FIG. 1 is a longitudinal sectional view through a tubular cutting tool, according to a preferred embodiment of the invention, with the upper and lower anchoring legs and the cutting blade fully retracted.

The preferred tubular cutting tool 2 illustrated in FIG. 1, has a cylindrical housing 4, having an upper housing section 6 to the top of the Figure and a lower housing section 8 to the bottom of the Figure. The upper and lower housing sections are locked together by weakened linking pins 10. An electrically driven rotary cutting head 12 having a retractable cutting blade 14 is mounted on the end of the lower housing section 8 distant from the upper housing section 6. The electrically driven rotary cutting head 12 is locked to the lower housing section 8 by weakened linking pins 16. The end of the electrically driven rotary cutting head 12 distant to the lower housing section 8 has a tapered nose cone 18.

A deployment cable and an interface electronics cartridge, are attached to the upper end of the upper housing section 6, distant to the lower housing section 8; for simplicity the electronics cartridge and deployment cable have been omitted from the FIGS.. The upper end portion 20 of the upper housing section 6 contains a set of electrical connectors/pressure barriers 22 and a floating piston 24, which are separated from one another by a space 26. The lower end portion 28 of the upper housing section 6 contains a first electric motor 30, having an integral gearbox not shown in the FIGS., which is coupled via a first torque limiter 32 to a ball screw 34, which is in turn coupled via a carriage 36 to a hollow central shaft 38. The ball screw 34 is surrounded by a compression spring 40.

The hollow central shaft 38 extends from the lower portion 28 of the upper housing section 6 of the tubular cutting tool 2 into the lower housing section 8 of the tubular cutting tool 2. A stationary protective cylinder 42, accommodating electrical wiring, runs through the hollow central shaft 38 from the upper housing section 6 to a connector 44 in the lower housing section 8. The connector 44 is coupled to a second electric motor 46. The second electric motor 46 is connected to a three stage planetary gearbox 48 which is coupled to a shaft 50. The shaft 50 is joined by a splined connection 51 to the electrically driven rotary cutting head 12 mounted on the lower end of the lower housing section 8.

Figure 2:
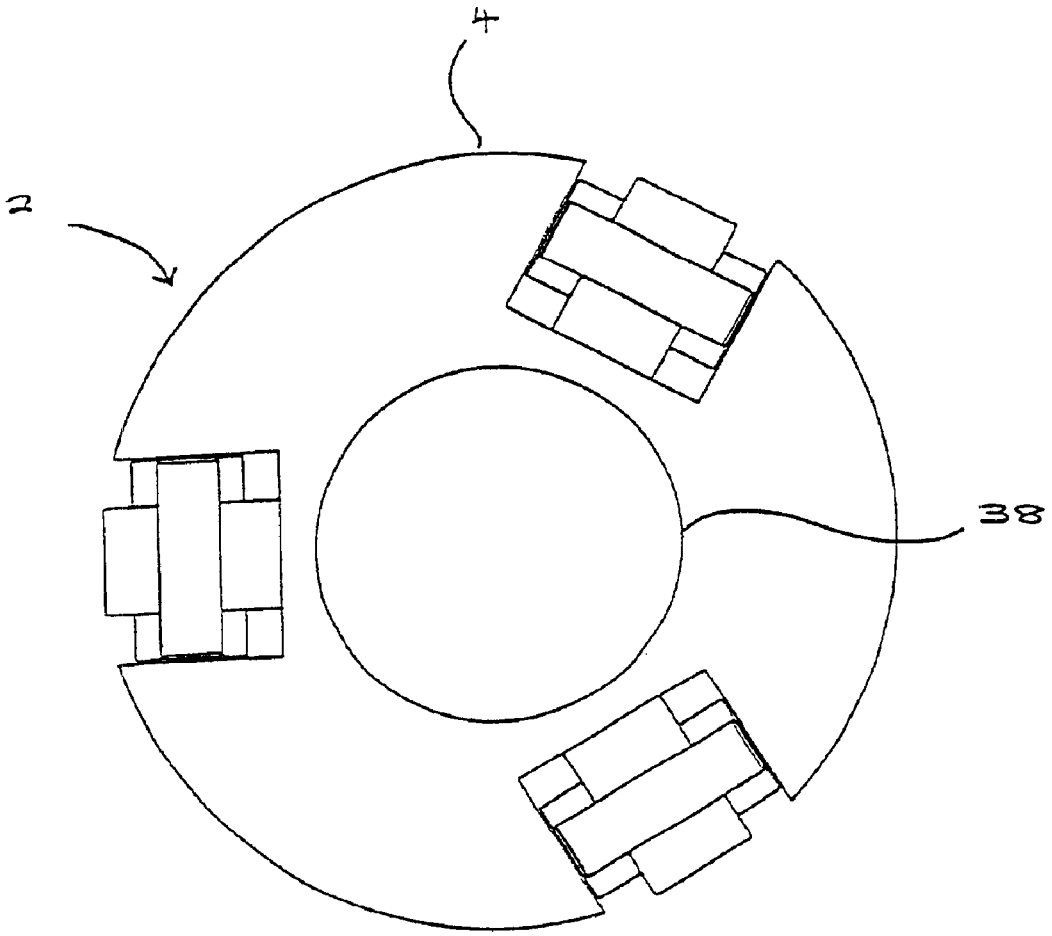
FIG. 2 shows a transverse sectional view of the tubular cutting tool of FIG. 1 with the upper and lower anchoring legs fully retracted.

The lower housing section 8 also contains a set of upper mechanical anchoring legs 52, mounted around the central shaft 38 in the upper portion of the lower housing section 8, and a set of lower mechanical anchoring legs 54, mounted around the shaft 50 in the lower portion of the lower housing section 8. The legs are shown in greater detail in FIGS. 3, 4A, 4B and 5. As shown in FIG. 2, each of the sets of anchoring legs is comprised of three individual anchoring legs which are disposed circumferentially around the cylindrical housing 4 at 120° degree intervals. For clarity, FIGS. 1, 3, 4A and 4B show two of the individual anchoring legs of the upper set of mechanical anchoring legs as though they were diametrically opposed. Throughout the following discussion, reference will only be made to the components and mode of operation of an upper leg 56 and a lower leg 58, but it is to be understood that the components of all upper and all lower legs are identical, and that references to the mode of operation of the upper leg 56 and the lower leg 58 apply equally to the other upper and lower legs, respectively.

Upper leg 56 comprises a leg section 60 and a leg section 62, both of which are pivoted about a parallel axis directed tangentially. The leg sections 60 and 62 are connected at a hinge joint 64 between the leg sections, to form a jointed leg-pair assembly. The end of the leg section 60 distant to the hinge joint 64 with the leg section 62 is mounted by a pivot pin 66 to a mounting block 68, which is fixed relative to the cylindrical housing 4. The end of the leg section 62 distant to the hinge joint 64 with the leg section 60, is mounted by a pivot pin 70 to a mounting block 72 which is longitudinally moveable relative to the cylindrical housing 4. Adjacent to the side of the mounting block 72 distant to the mounting block 68, a first or upper spring stack 74, having a spring 76, is mounted on the central shaft 38. A deployment block 78, which is connected to the central shaft 38, is mounted adjacent to the side of the upper spring stack 74 distant to the mounting block 72. A ring 79, which is connected to the central shaft 38, is mounted adjacent to the side of the mounting block 72 distant to the upper spring stack 74.

Lower leg 58 comprises a leg section 80 and a leg section 82, both of which are pivoted about a parallel axis directed tangentially. The leg sections 80 and 82 are connected at a hinge joint 84 between the leg sections, to form a jointed leg-pair assembly. The end of the leg section 80 distant to the hinge joint 84 with the leg section 82 is mounted by a pivot pin 86 to a mounting block 88, which is fixed relative to the cylindrical housing 4. The end of the leg section 82 distant to the hinge joint 84 with the leg section 80, is mounted by a pivot pin 90 to a mounting block 92 which is longitudinally moveable relative to the cylindrical housing 4. The mounting block 92 contains a linkage 94 which is attached to one end of an outer sleeve 96 of the cylindrical housing 4. The other end of the outer sleeve 96 is attached to a linkage 98 which is contained in a block 99 mounted, in the upper portion of the lower housing section 8, on the central shaft 38 adjacent to the side of the deployment block 78 distant to the upper spring stack 74. Adjacent to the side of the linkage 98 distant to the deployment block 78, a second or lower spring stack 100, having a spring 102, is mounted on the central shaft 38. A deployment block 104, which is connected to the central shaft 38, is mounted adjacent to the side of the lower spring stack 100 distant to the linkage 98.

Figure 6:
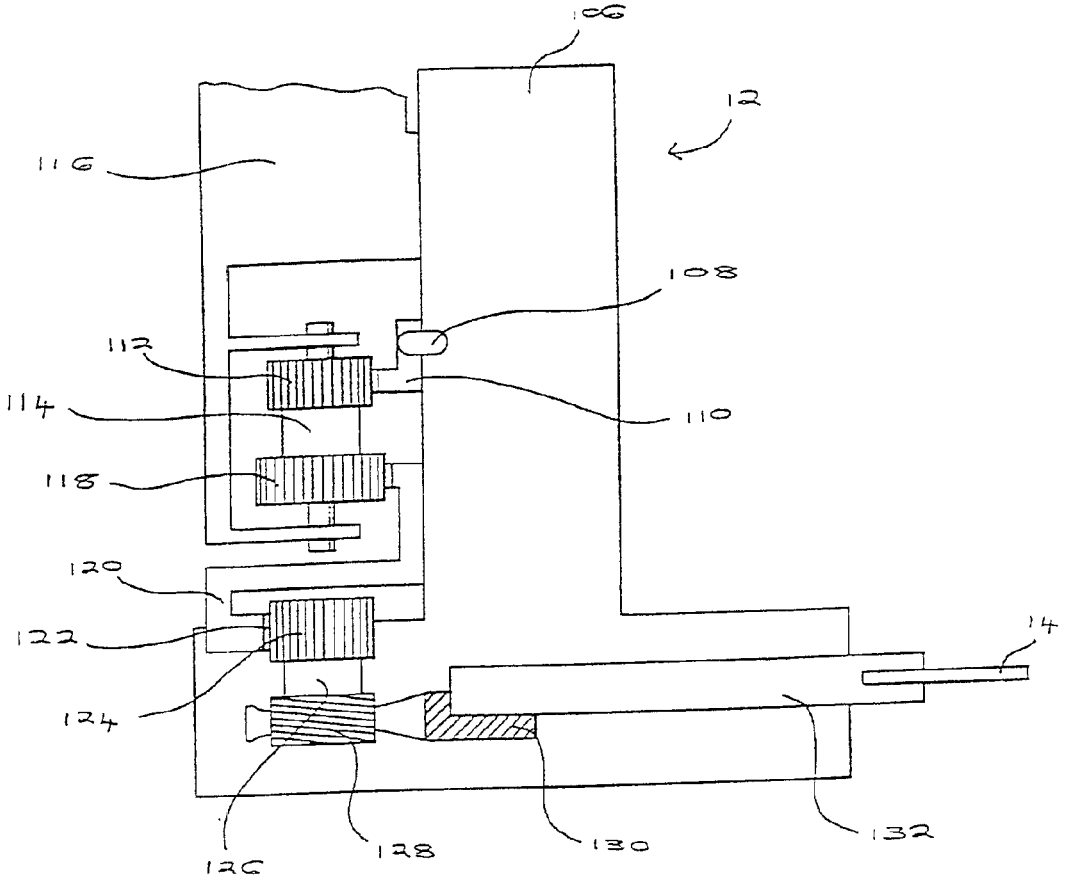
FIG. 6 shows the rotary electric cutting head of the tubular cutting tool of FIG. 1.

The electrically driven rotary cutting head 12 of the tubular cutting tool 2 is shown in greater detail in FIG. 6 in which, for clarity, all the parts are shown in the same plane. The electrically driven rotary cutting 12 head comprises a head shaft 106 coupled via a second torque limiter 108 to a primary gear ring 110 which rides on the head shaft 106. The primary gear ring 110 engages a first pinion 112 on a pair of compound idler gears 114 which are located in an extension 116 to the cylindrical housing 4; in FIG. 6 for simplicity only one of the compound idler gears is shown. A second pinion 118 on the compound idler gears 114 engages an external ring gear on a transfer ring 120 which is located on the head shaft 106. An internal ring gear 122 on the transfer ring 120 engages a pinion 124 mounted on a drive shaft 126 in the electrically driven rotary cutting head 12. The drive shaft 126 is connected to a worm which is mounted on a wheel 128. The wheel 128 is mounted on a drive thread 130 which is connected to a blade holder 132 which holds the cutting blade 14; the worm lies out of the plane of FIG. 6. The cutting blade 14 is held in the blade holder 132 by three bolts 134. The blade holder 132 is locked to the remainder of the electrically driven cutting head 12 by three weakened linking pins; the three pins are not shown in the Figures.

The mode of operation of the preferred embodiment of the invention will now be described.

The preferred tubular cutting tool 2 illustrated in FIG. 1 is lowered or pushed into the borehole, pipeline or other tubular to be cut on an deployment cable. Once the apparatus is in position, power is applied down the cable, together with telemetry signals, to the interface electronics cartridge attached to the upper end of the upper housing section 6 of the tool, farthest from the electrically driven rotary cutting head 12; for simplicity the electronics cartridge and deployment cable have been omitted from the Figures.

The initial or starting configuration of the tool having been lowered or pushed into the tubular is shown in FIG. 1. As power is supplied, the first electric motor 30 drives the ball screw 34, by way of the internal gearbox, winding the carriage 36 up the thread of the ball screw 34, towards the first electric motor 30. The movement of the carriage 36 results in the longitudinal movement of the central shaft 38 in the same direction. The movement of the central shaft 38 results in the longitudinal movement of the ring 79 and the deployment block 78, which are attached thereto, towards the first electric motor 30 and the upper leg 56. As the deployment block 78 moves towards the upper leg 56, it pushes upon the adjacent upper spring stack 74 which is mounted on the central shaft 38. The pushing force exerted by the deployment block 78 on the upper spring stack 74 causes the stack to slide longitudinally along the central shaft 38 and thereby to push upon the adjacent mounting block 72. The pushing force exerted on the mounting block 72 causes the block to slide longitudinally along the central shaft 38 towards the mounting block 68, which is fixed relative to the cylindrical housing 4. As the mounting block 72 slides towards the mounting block 68, the upper leg section 62 is forced to pivot in a clockwise direction about the pivot pin 70, and the upper leg section 60 is forced to pivot in an anti-clockwise direction about the pivot pin 66, thereby slowly forcing the hinge joint 64 radially outwards towards the internal wall of the tubular to be cut.

Simultaneously, the longitudinal movement of the central shaft 38 results in the longitudinal movement of the deployment block 104, which is attached thereto, towards the upper leg 56. As the deployment block 104 moves towards the upper leg 56, it pushes upon the adjacent lower spring stack 100 which is mounted on the central shaft 38. The pushing force exerted by the deployment block 104 on the lower spring stack 100 causes the stack to slide longitudinally along the central shaft 38 and thereby to push upon the adjacent block 99 containing the linkage 98, to which the outer pull sleeve 96 of the cylindrical housing 4 is attached. The pushing force exerted on the linkage 98 causes the linkage to slide longitudinally along the central shaft 38 towards the upper leg 56. As the linkage 98 slides towards the upper leg 56, the outer pull sleeve 96 of the cylindrical housing 4, and the deployment block 92 which is attached thereto by way of linkage 94, are pulled in the direction of movement of the central shaft 38. The pulling force exerted on the deployment block 92 causes the block to slide longitudinally along the lower housing section 8 in the direction of movement of the central shaft 38. As the deployment block 92 slides, the lower leg section 82 is forced to pivot in a clockwise direction about the pivot pin 90, and the lower leg section 80 is forced to pivot in an anti-clockwise direction about the pivot pin 86, thereby slowly forcing the hinge joint 84 radially outwards towards the internal wall of the tubular to be cut. In the preferred embodiment of the invention, the surfaces of the upper and lower jointed leg-pair assemblies which, when the legs are in the anchoring position, contact the internal wall of the tubular are sharpened or knurled such as to provide grip on the internal wall of the tubular.

As the upper anchoring leg 56 contacts the internal wall of the tubular, the longitudinal movement of the mounting block 72 along the central shaft 38 is restricted and the force exerted by the deployment block 78 on the upper spring stack 74 increases, causing the upper spring 76 to compress slightly.

As the lower anchoring leg 58 contacts the internal wall of the tubular, the longitudinal movement of the mounting block 92, and consequently of the linkage 94 and outer pull sleeve 96, is restricted. As a result, the force exerted by the deployment block 104 on the lower spring stack 100 increases, causing the lower spring 102 to compress slightly.

Figure 4A:
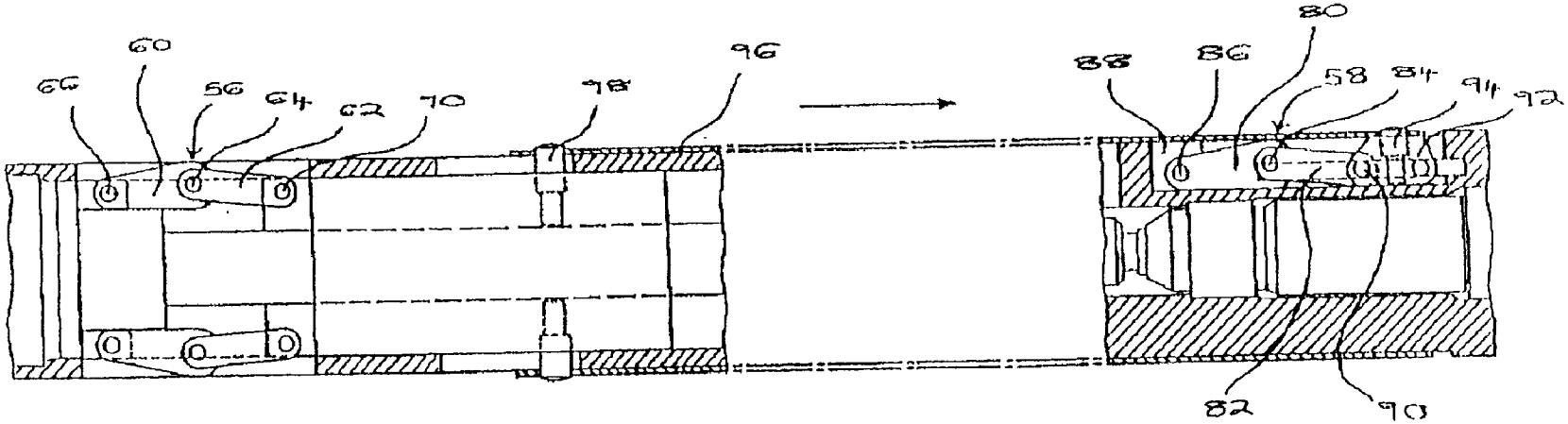
FIG. 4A shows the upper and lower anchoring leg arrangement of the tubular cutting tool of FIG. 1 with the legs fully retracted.
Figure 4B:
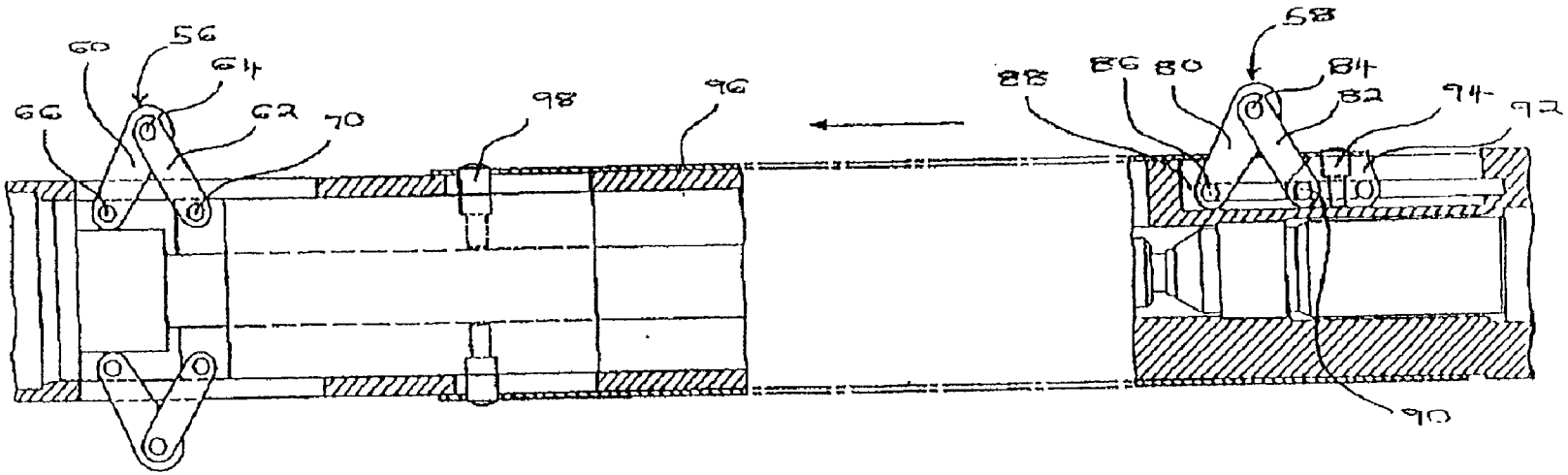
FIG. 4B shows the upper and lower anchoring leg arrangement of the tubular cutting tool of FIG. 1 with the legs radially extended.
Figure 5:
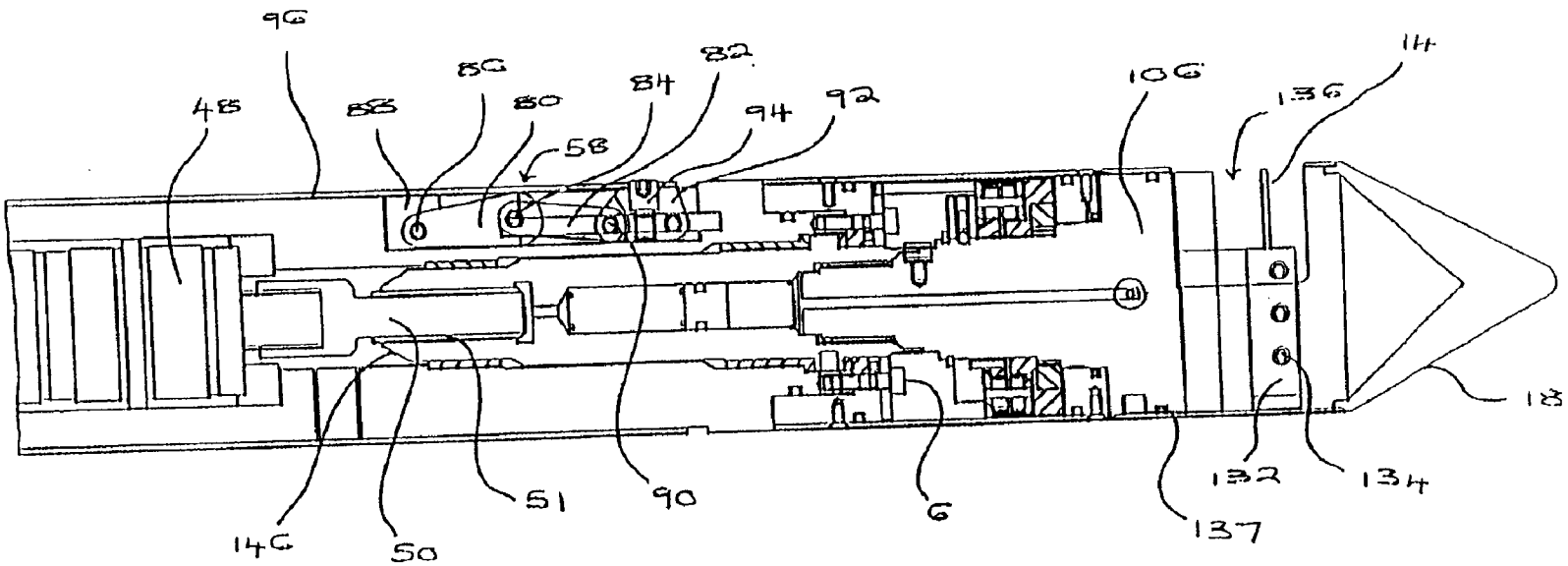
FIG. 5 shows a longitudinal sectional view through the rotary cutting head of the tubular cutting tool of FIG. 1.

Compression of the springs occurs independently for the upper and lower anchoring leg sets, allowing the upper and lower legs to deploy to a slightly different radii while maintaining a similar level of force on the internal wall of the tubular. Compression of the springs thereby provides compensation for any small variation in the internal radii of the tubular between the sets of upper and lower legs, ensuring the tubular cutting tool 2 is clamped rigidly, and nominally centrally, in position within the tubular. FIG. 4B shows the upper and lower mechanical anchoring leg arrangement of the tubular cutting tool 2 of FIG. 4A with the legs radially extended; for simplicity, the upper and lower spring stacks have been omitted from FIGS. 4A and 4B. In the preferred embodiment of the invention, the springs employed in the upper and lower spring stacks are belleville washers, it will be appreciated, however, that any resilient material could be used.

As the force exerted by the anchoring legs on the internal wall of the tubular increases, so does the torque associated with the first electric motor 30. At a certain torque, the first torque limiter 32, which may simply be a clutch or spline, operates preventing the first electric motor 30 from stalling; an electronic current limiter could be employed instead of the torque limiter 32. The electronics then cut power to the first electric motor 30.

A telemetry signal then instructs the electronics to divert power to the second electric motor 46. The second electric motor 46 drives the shaft 50, which in turn drives the rotary cutting head 12, shown in greater detail in FIGS. 5 and 6, by way of the three stage planetary gearbox 48. As the rotary cutting head 12 rotates, the gear train 110, 112, 114, 118, 120, 122, 124, 126, 128 and 130 advances the blade holder 132 radially outwards, towards the internal wall of the tubular; at this point the blade holder 132 is rotating and advancing. The rotary cutting head 12 of the preferred embodiment of the tubular cutting tool 2 further comprises a spring loaded window which in the initial or starting configuration of the tubular cutting tool 2 covers an aperture 136, thereby protecting the cutting blade 14 as the tubular cutting tool 2 is lowered into the tubular to be cut. The window is designed such that on the first revolution of the electrically driven rotary cutting head 12 the window opens to expose the cutting blade 14, allowing the blade holder 132 to be advanced through the aperture 136 on subsequent revolutions of the electrically driven rotary cutting head 12. The window is driven by the rotation of the electrically driven rotary cutting head 12 by way of a torque limiter 137. In the preferred embodiment of the invention, the torque limiter 137 is a canted-coil spring, but may alternatively be a sealing element.

The gear train 110, 112, 114, 118, 120, 122, 124, 126, 128 and 130 is designed such that, through a mismatch of gears, the blade holder 132 is advanced slowly, by a fixed amount per revolution of the electrically driven rotary cutting head 12, and is adjusted such that an optimum advance rate is achieved. If the blade holder 132 advances too slowly, the cutting blade 14 will grind on the internal wall of the tubular, and if it advances too quickly heavy loads will be experienced.

The blade holder 132 moves transversely in a dovetailed groove in the rotary cutting head 12 such that rotation of the head shaft 106 advances the blade holder 132. As the head shaft 106 rotates, the gear train 110, 112, 114, 118, 120, 122, 124, 126, 128 and 130 simultaneously converts the rotation to a continuous geared feed of the blade holder 132. As the head shaft 106 rotates, the primary gear ring 110, coupled thereto, drives the first pinion 112 on the compound idler gears 114. The second pinion 118 on the compound idlers then drives the external ring gear on the transfer ring 120. As a result, the internal ring gear 122 on the transfer ring 120 drives the pinion 124 mounted on the drive shaft 126. The drive shaft 126 turns the worm which rotates the wheel 128 on the drive thread 130 which in turn advances the blade holder 132. The overall arrangement is such that rapid rotation of the head shaft 106, typically of the order of 75 revolutions per minute (rpm), causes the worm to slowly advance the cutting blade 14, typically by about a few thousandths of an inch per revolution of the head shaft 106; the slowness of the advance is achieved by the small difference in gear ratios as the rotary motion of the head shaft 106 is picked up by the compound idler gears 114 and then transferred back to the wheel 128. The advance rate of the cutting blade 14 per revolution of the head shaft 106 is independent of the speed of rotation of the head shaft 106 and is altered by adjustment of the worm. In the preferred embodiment of the tubular cutting tool 2 the head is filled with oil as far as possible.

The blade holder 132 advances until the cutting blade 14 contacts the internal wall of the tubular and commences cutting. In the event that the mechanical anchoring legs slip while the cutting blade 14 is in the cutting position, in contact with the internal wall of the tubular, rotation of the cutting head 12 will have the undesirable tendency to cause the entire tubular cutting tool 2 to rotate and the deployment cable to, therefore, twist. In the preferred embodiment of the invention, in order to prevent rotation of the entire tubular cutting tool 2 and twisting of the cable, the deployment cable is attached to the tubular cutting tool 2 by a swivel joint and a centrifugal switch, which cuts power to the electrically driven rotary cutting head 12 if rotation of the tubular cutting tool 2 is detected, is incorporated into either the interface electronics cartridge or the top of the tubular cutting tool 2. Additionally, in the preferred embodiment of the invention, cylinders 138, as shown in FIGS. 1 and 3, may be included in the upper and/or lower spring stacks in order to limit the longitudinal movement of the spring stacks once the anchoring legs are deployed and thereby prevent the upper and/or lower anchoring legs collapsing under heavy dynamic side loads generated by the rotation of the cutting head 12.

During the cutting process, the electric current consumption and rpm of the rotary cutting head 12 are monitored remotely, via telemetry, by the operator of the tubular cutting tool 2. Once the cutting blade 14 has advanced a sufficient amount, and the tubular is fully cut, the operator observes a drop in power consumption and instructs the tubular cutting tool 2 to stop. Power is then applied in reverse to the second electric motor 46. The shaft 50 drives the rotary cutting head 12 in the opposite direction, by way of the three stage planetary gearbox 48. Since the cutting system is positively geared, reversing the rotation of the cutting head 12 causes the blade holder 132, and therefore the cutting blade 14, to slowly retract radially inwards, away from the internal wall of the cut tubular. Once the blade holder 132 is returned to its home starting position, shown in FIG. 1, the second torque limiter 108 operates to prevent the second electric motor 46 from stalling. The electronics then cut power to the second electric motor 46. The resulting cut edge of the tubular is clean and reminiscent of a machined edge; the use of the sets of upper legs 52 and lower legs 54 provides a rigid stable platform with which to apply the rotary cutting blade to the wall of the tubular without danger of the blade breaking or gouging.

A telemetry signal then instructs the electronics to apply reverse power to the first electric motor 30. The first electric motor 30 drives the ball screw 34 in the opposite direction, winding the carriage 36 down the thread of the ball screw 34, away from the first electric motor 30. The longitudinal movement of the central shaft 38 pushes the ring 79 and the deployment block 78 towards the rotary cutting head 12, back to the initial position shown in FIGS. 1 and 3. As the ring 79 moves towards the rotary cutting head 12, it pushes upon the adjacent mounting block 72 causing both the mounting block 72 and the adjacent upper spring stack 74 to slide longitudinally along the shaft away from the mounting block 68; the pushing force exerted by the deployment block 78 on the upper spring stack 74 having been removed by the movement of the deployment block 78 towards the rotary cutting head 12. As the mounting block 72 slides away from the mounting block 68, the upper leg section 60 pivots in a clockwise direction about the pivot pin 66, and the upper leg section 62 pivots in an anti-clockwise direction about the pivot pin 70, thereby slowly drawing the hinge joint 64 radially inwards away from the internal wall of the cut tubular, ultimately to the fully retracted starting position shown in FIGS. 1, 3 and 4A.

Figure 3:
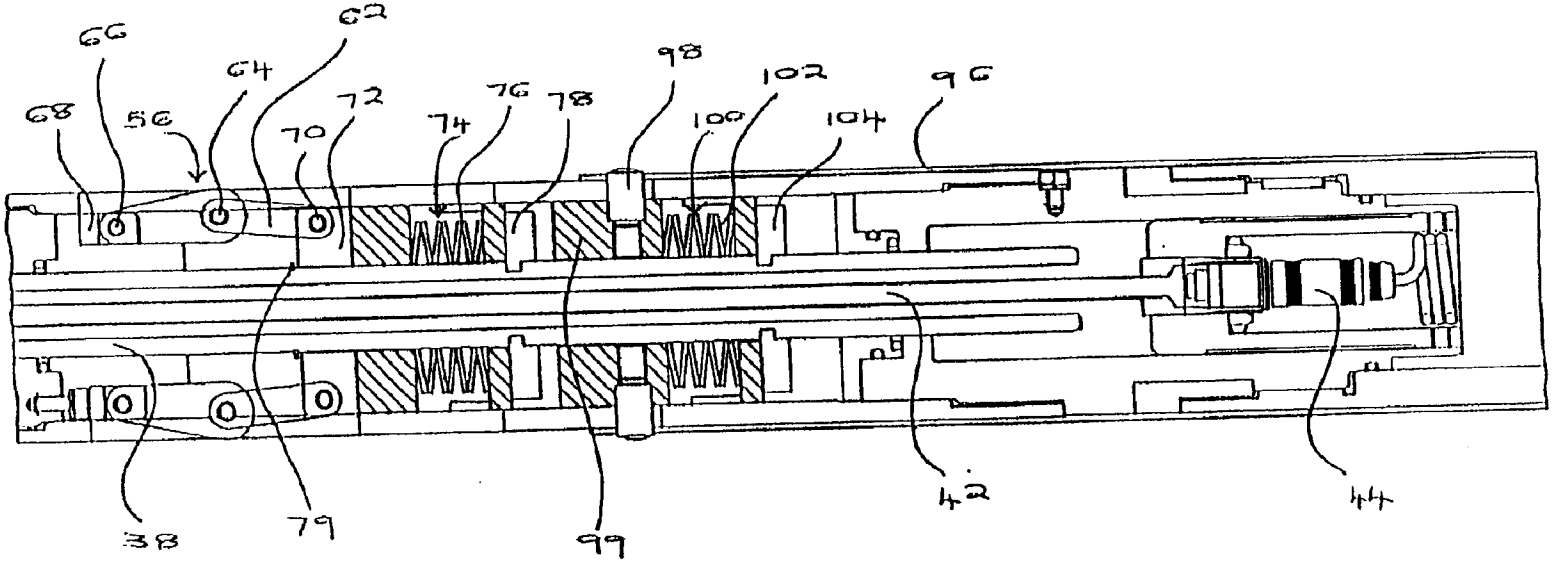
FIG. 3 shows the upper anchoring leg arrangement of the tubular cutting tool of FIG. 1 with the legs fully retracted.

Simultaneously, the longitudinal movement of the central shaft 38 pushes the deployment block 104 towards the rotary cutting head 12, back to the initial position shown in FIGS. 1 and 3, thereby removing the pushing force exerted by the deployment block 104 on the lower spring stack 100. As the deployment block 78 moves towards the rotary cutting head 12, it pushes upon the block 99 causing the block 99, the linkage 98, contained therein, and the adjacent lower spring stack 100 to slide longitudinally along the central shaft 38 away from the upper leg 56, towards the rotary cutting head 12. As the linkage 98 moves towards the rotary cutting head 12, the outer pull sleeve 96 of the cylindrical housing 4, and the mounting block 92 which is attached thereto by way of the linkage 94, are pushed towards the rotary cutting head 12. The pushing force exerted on the mounting block 92 causes the block to slide longitudinally towards the electrically driven rotary cutting head 12. As the mounting block 92 slides, the lower leg section 80 pivots in a clockwise direction about the pivot pin 86, and the lower leg section 82 pivots in an anti-clockwise direction about the pivot pin 90, thereby slowly drawing the hinge joint 84 radially inwards away from the internal wall of the cut tubular, ultimately to the fully retracted starting position shown in FIGS. 1, 4A and 5.

Once the upper and lower anchoring legs are fully retracted, the tubular cutting tool 2 may be moved to an alternative position inside the tubular in order to perform another cut, or the apparatus may be pulled out of the tubular and recovered. In the preferred embodiment described, the upper and lower legs are orientated such that, when in the deployed position shown in FIG. 4B, the weight of the tubular cutting tool 2 tends to force the anchoring legs radially further outwards, but so that pulling on the tubular cutting tool 2 from above, on the deployment cable, tends to force the anchoring legs radially inwards to the retracted position shown in FIG. 4A. Additionally, in the preferred embodiment of the invention the surfaces of the upper and lower jointed leg-pair assemblies which, when the legs are in the deployed position, contact the internal wall of the tubular are slightly cam shaped in the direction tangential to the central shaft 38 such that the reaction torque generated by rotation of the electrically driven rotary cutting head 12 tends to increase the radial force exerted by the legs on the internal wall of the tubular. Although the preferred embodiment described has three upper anchoring legs and three lower anchoring legs, it will be appreciated that two or more upper and/or lower legs could be used to provide sufficient anchoring force to hold the tubular cutting tool 2 in position within the tubular. It will also be appreciated that while the retractable anchoring means of the preferred embodiment of the tubular cutting tool described consists of upper and lower sets of jointed leg-pairs disposed circumferentially around the housing, other, similarly disposed, anchoring means could be employed, such as wedges disposed in wedge-shaped slots around the housing; such means are commonly termed "slips" in the art.

In the preferred embodiment of the invention described, the second electrically powered actuating means, for advancing and retracting the cutting blade 14, and the third electrically powered actuating means, for rotating the rotary cutting head 12, are powered by a common electric motor, the second electric motor 46. It will be appreciated that the second and third electrically powered or controlled actuating means could alternatively be powered or controlled by two separate electric motors. In addition, in the preferred embodiment of the invention described, the first electrically powered actuating means, for moving the retractable anchoring means 52 and 54, and the second and third electrically powered actuating means are powered by two separate electric motors, the first electric motor 30 and the second electric motor 46. It will be appreciated that, with the inclusion of additional gearboxes and torque limiters, the first, second and third electrically powered or controlled actuating means could alternatively be powered or controlled by a single, common electric motor. In the preferred embodiment of the invention the first, second and third actuating means, for moving the retractable anchoring means, rotating the rotary cutting head and advancing and retracting the cutting blade respectively, are powered directly by one or more electric motors. It will be appreciated, however, that the actuating means could alternatively comprise an electrohydraulic system, wherein one or more electric motors are used to control a number of pressure compensated hydraulic pumps and/or motors which then power the retractable anchoring means, rotary cutting head and cutting blade.

In addition to the features already discussed, the preferred embodiment of the tubular cutting tool 2 also comprises features which enable the tubular cutting tool 2 to be recovered from a tubular in the event that the mechanism for retracting the upper and lower anchoring legs should fail, as a result of loss of electrical power, for example. Pulling upon or winching the deployment cable produces tension at the top end of the tubular cutting tool 2 furthest from the rotary cutting head 12, and exerts a shearing force on the weakened linking pins 10 which lock the upper housing section 6 of the cylindrical housing 4 to the lower housing section 8. A narrow section 140 of the weakened linking pins 10 are designed to shear under such force, and once this occurs, further pulling upon the deployment cable, and hence the upper housing section 6, causes the upper housing section 6 to pull away from the lower housing section 8, until a wider section 142 of the weakened linking pins 10 engages a flange 144 of the lower housing section 8. The longitudinal movement of the upper housing section 6 relative to the lower housing section 8, pulls the first torque limiter 32, connected to the first electric motor 30, apart causing it to disengage, as a result of which the ball screw 34 is able to "free wheel". In the absence of motor power, the compression spring 40 drives the ball screw 34, winding the carriage 36 down the thread of the ball screw 34, away from the first electric motor 30. The resultant movement of the central shaft 38 in the same direction, causes the radially extended upper and lower sets of anchoring legs to collapse, away from the internal wall of the tubular, against the tool weight and deployment cable tension in the manner previously described. Once the upper and lower anchoring legs have collapsed, the tubular cutting tool 2 may be recovered intact from the tubular by further pulling on the deployment cable.

In the event that the electrically driven rotary cutting head mechanism jams whilst the cutting blade 14 is advanced and in contact with the internal wall of the tubular being cut, there are three possible ways in which the preferred embodiment of the tubular cutting tool 2 may be recovered by the operator from within the tubular. Firstly, pulling on the deployment cable may cause the cutting blade 14 to snap thereby freeing the remainder of the tubular cutting tool 2, which can then be recovered from the tubular by further pulling on the cable. In the preferred embodiment of the invention the cutting blade 14 is intentionally weakened near to the tip to facilitate breakage.

Secondly, if pulling on the deployment cable does not cause the cutting blade 14 to snap, it will exert a shearing force on the three weakened linking pins which lock the blade holder 132 to the remainder of the rotary cutting head 12; it will be appreciated that different numbers of linking pins could be employed. The weakened linking pins 134 are designed to shear under such force, thereby separating the deployed cutting blade 14 and blade holder 132 from the remainder of the tubular cutting tool 2 which can then be recovered from the tubular by further pulling on the deployment cable.

Finally, if pulling on the deployment cable fails either to snap the blade or to cause the three weakened linking pins 134 to shear, it will exert a shearing force on the weakened linking pins 16 which lock the lower housing section 8 of the cylindrical housing to the non-rotating extension 116 of the rotary cutting head 12. The weakened linking pins 16 are designed to shear under such force, thereby enabling the splined connection 51 between the rotary cutting head 12 and the shaft 50 to be uncoupled by further pulling on the deployment cable. The upper and lower housing sections of the tubular cutting tool 2 can then be recovered by pulling on the deployment cable, leaving the cutting head 12 behind in the tubular. In the preferred embodiment of the invention, the profile of the neck 146 of the rotary cutting head 12 which forms the splined connection 51 with the shaft 50 is such that it can be easily latched onto using conventional recovery equipment, thereby allowing the rotary cutting head 12 of the tubular cutting tool 2 to be subsequently recovered from the tubular.

In the preferred embodiment of the invention, the entire internal workings of the tubular cutting tool 2 are filled with an oil, or another suitable fluid, which is then pressurized. The oil, or other fluid, is introduced into the tubular cutting tool 2 through filling/drainage parts 148 in the upper housing section 6 of the cylindrical housing 4 and then pressurized by means of the floating piston 24; the unoccupied space 26 in the upper housing section 6 acts as a reservoir for the oil or other fluid. Production of a tubular cutting tool with thin outer walls is desirable as a method of reducing the overall diameter of the tool, thereby enabling the tool to be employed to cut tubulars of narrow internal diameter. However, decreasing the outer wall thickness of the tool reduces its ability to withstand the external over-pressure experienced in the tubular borehole liner or pipeline to be cut, which may exceed 15,000 psi (1000 atm.). Filling the internal workings of the tool with an oil, or another fluid, which is then pressurized by means of the floating piston 24, compensates for the reduced external pressure resistance of a thin outer wall by equalizing the internal pressure within the tool to match the external pressure experienced by it when inside a typical tubular or borehole. In addition, filling the tool with a pressurized fluid means that the mechanical anchoring mechanism is compensated for the external hydrostatic pressure within the tubular and does not, therefore, have to overcome it in order to move from the retracted position to the anchoring position. The tubular cutting tool 2 according to the preferred embodiment of the invention has an overall external diameter of between about 2 inches (50 mm) and about 4 inches (100 mm), more preferably between about 2.5 inches (64 mm) and about 3 inches (76 mm), making it suitable for use in cutting tubulars with internal diameters of between about 3.5 inches (89 nun) and about 10 inches (254 mm)

What is claimed is:

1. A tubular cutting tool for remotely cutting tubulars from the inside, comprising:

a housing;

two or more sets of retractable anchors mounted in the housing at longitudinally spaced apart locations, adapted to be advanced from an initial retracted position out of contact with the internal wall of a tubular to be cut to an anchoring position in contact with the internal wall of the tubular, such as to anchor the tubular cutting tool rigidly in position within the tubular, and to be subsequently retracted from the anchoring position back to the retracted position;

a first electrically powered or controlled actuator mounted in the housing and coupled to the retractable anchors for moving the retractable anchors from the retracted position to the anchoring position prior to performing a cut and then for moving the retractable anchors from the anchoring position back to the retracted position once a cut has been performed;

a rotary cutting head mounted on the housing, the rotary cutting head having a retractable cutting blade adapted to be progressively advanced, by rotation of the rotary cutting head, from an initial retracted position out of contact with the internal wall of the tubular to a cutting position in contact with the internal wall of the tubular, and to be subsequently retracted, by rotation of the rotary cutting head, from the cutting position back to the retracted position out of contact with the internal wall of the tubular once a cut has been performed;

a second electrically powered or controlled actuator mounted in the housing and coupled to the retractable cutting blade for progressively advancing the cutting blade from the initial retracted position out of contact with the internal wall of the tubular towards the internal wall of the tubular and for subsequently retracting the cutting blade back to the retracted position out of contact with the internal wall of the tubular once a cut has been performed; and a third electrically powered or controlled actuator mounted in the housing and coupled to the rotary cutting head for rotating the rotary cutting head.

2. A tubular cutting tool according to claim 1 wherein the retractable cutting blade is advanced by a fixed amount per revolution of the rotary cutting head.

3. A tubular cutting tool for remotely cutting tubulars from the inside, comprising:

a housing;

two or more sets of retractable anchoring means mounted in the housing at longitudinally spaced apart locations, adapted to be advanced from an initial retracted position out of contact with the internal wall of a tubular to be cut to an anchoring position in contact with the internal wall of the tubular, such as to anchor the tubular cutting tool rigidly in position within the tubular, and to be subsequently retracted from the anchoring position back to the retracted position;

first electrically powered or controlled actuating means mounted in the housing and coupled to the retractable anchoring means for moving the retractable anchoring means from the retracted position to the anchoring position prior to performing a cut and then for moving the retractable anchoring means from the anchoring position back to the retracted position once a cut has been performed;

a rotary cutting head mounted on the housing, the rotary cutting head having a retractable cutting blade adapted to be progressively advanced from an initial retracted position out of contact with the internal wall of the tubular to a cutting position in contact with the internal wall of the tubular, and to be subsequently retracted from the cutting position back to the retracted position out of contact with the internal wall of the tubular once a cut has been performed;

second electrically powered or controlled actuating means mounted in the housing and coupled to the retractable cutting blade for progressively advancing the cutting blade from the initial retracted position out of contact with the internal wall of the tubular towards the internal wall of the tubular and for subsequently retracting the cutting blade back to the retracted position out of contact with the internal wall of the tubular once a cut has been performed;

third electrically powered or controlled actuating means mounted in the housing and coupled to the rotary cutting head for rotating the rotary cutting head; and compensation means mounted in the housing between one or more of the sets of retractable anchoring means and the first electrically powered or controlled actuating means for moving the retractable anchoring means, the compensation means being adapted to compensate for small variations in the internal radii of the tubular between two or more sets of the retractable anchoring means when in the anchoring position.

4. A tubular cutting tool according to claim 3 wherein the compensation means comprises a resilient material which is compressed as the retractable anchoring means are moved from the initial retracted position out of contact with the internal wall of the tubular to the anchoring position in contact with the internal wall of the tubular.

5. A tubular cutting tool for remotely cutting tubulars from the inside, comprising:

a housing, said housing including two or more sections linked together by one or more linking pins designed to break under a shearing or tensional force;

two or more sets of retractable anchors mounted in the housing at longitudinally spaced apart locations, adapted to be advanced from an initial retracted position out of contact with the internal wall of a tubular to be cut to an anchoring position in contact with the internal wall of the tubular, such as to anchor the tubular cutting tool rigidly in position within the tubular, and to be subsequently retracted from the anchoring position back to the retracted position;

a first electrically powered or controlled actuator mounted in the housing and coupled to the retractable anchors for moving the retractable anchors from the retracted position to the anchoring position prior to performing a cut and then for moving the retractable anchors from the anchoring position back to the retracted position once a cut has been performed;

a rotary cutting head mounted on the housing, the rotary cutting head having a retractable cutting blade adapted to be progressively advanced from an initial retracted position out of contact with the internal wall of the tubular to a cutting position in contact with the internal wall of the tubular, and to be subsequently retracted from the cutting position back to the retracted position out of contact with the internal wall of the tubular once a cut has been performed;

a second electrically powered or controlled actuator mounted in the housing and coupled to the retractable cutting blade for progressively advancing the cutting blade from the initial retracted position out of contact with the internal wall of the tubular towards the internal wall of the tubular and for subsequently retracting the cutting blade back to the retracted position out of contact with the internal wall of the tubular once a cut has been performed; and a third electrically powered or controlled actuator mounted in the housing and coupled to the rotary cutting head for rotating the rotary cutting head.

6. A tubular cutting tool for remotely cutting tubulars from the inside, comprising:

a housing;

two or more sets of retractable anchors mounted in the housing at longitudinally spaced apart locations, adapted to be advanced from an initial retracted position out of contact with the internal wall of a tubular to be cut to an anchoring position in contact with the internal wall of the tubular, such as to anchor the tubular cutting tool rigidly in position within the tubular, and to be subsequently retracted from the anchoring position back to the retracted position;

a first electrically powered or controlled actuator mounted in the housing and coupled to the retractable anchors for moving the retractable anchors from the retracted position to the anchoring position prior to performing a cut and then for moving the retractable anchors from the anchoring position back to the retracted position once a cut has been performed;

a rotary cutting head mounted on the housing, the rotary cutting head having a retractable cutting blade which is weakened at the tip and adapted to be progressively advanced from an initial retracted position out of contact with the internal wall of the tubular to a cutting position in contact with the internal wall of the tubular, and to be subsequently retracted from the cutting position back to the retracted position out of contact with the internal wall of the tubular once a cut has been performed;

a second electrically powered or controlled actuator mounted in the housing and coupled to the retractable cutting blade for progressively advancing the cutting blade from the initial retracted position out of contact with the internal wall of the tubular towards the internal wall of the tubular and for subsequently retracting the cutting blade back to the retracted position out of contact with the internal wall of the tubular once a cut has been performed; and a third electrically powered or controlled actuator mounted in the housing and coupled to the rotary cutting head for rotating the rotary cutting head.

7. A tubular cutting tool for remotely cutting tubulars from the inside, comprising:

a housing;

two or more sets of retractable anchors mounted in the housing at longitudinally spaced apart locations, adapted to be advanced from an initial retracted position out of contact with the internal wall of a tubular to be cut to an anchoring position in contact with the internal wall of the tubular, such as to anchor the tubular cutting tool rigidly in position within the tubular, and to be subsequently retracted from the anchoring position back to the retracted position;

a first electrically powered or controlled actuator mounted in the housing and coupled to the retractable anchors for moving the retractable anchors from the retracted position to the anchoring position prior to performing a cut and then for moving the retractable anchors from the anchoring position back to the retracted position once a cut has been performed;

a rotary cutting head mounted on the housing, the rotary cutting head having a retractable cutting blade adapted to be progressively advanced from an initial retracted position out of contact with the internal wall of the tubular to a cutting position in contact with the internal wall of the tubular, and to be subsequently retracted from the cutting position back to the retracted position out of contact with the internal wall of the tubular once a cut has been performed, the retractable cutting blade being coupled to the rotary cutting head by one or more linking pins designed to break under a shearing or tensional force;

a second electrically powered or controlled actuator mounted in the housing and coupled to the retractable cutting blade for progressively advancing the cutting blade from the initial retracted position out of contact with the internal wall of the tubular towards the internal wall of the tubular and for subsequently retracting the cutting blade back to the retracted position out of contact with the internal wall of the tubular once a cut has been performed; and a third electrically powered or controlled actuator mounted in the housing and coupled to the rotary cutting head for rotating the rotary cutting head.

8. A tubular cutting tool for remotely cutting tubulars from the inside, comprising:

a housing;

two or more sets of retractable anchors mounted in the housing at longitudinally spaced apart locations, adapted to be advanced from an initial retracted position out of contact with the internal wall of a tubular to be cut to an anchoring position in contact with the internal wall of the tubular, such as to anchor the tubular cutting tool rigidly in position within the tubular, and to be subsequently retracted from the anchoring position back to the retracted position;

a first electrically powered or controlled actuator mounted in the housing and coupled to the retractable anchors for moving the retractable anchors from the retracted position to the anchoring position prior to performing a cut and then for moving the retractable anchors from the anchoring position back to the retracted position once a cut has been performed;

a rotary cutting head mounted on the housing, the rotary cutting head having a retractable cutting blade adapted to be progressively advanced from an initial retracted position out of contact with the internal wall of the tubular to a cutting position in contact with the internal wall of the tubular, and to be subsequently retracted from the cutting position back to the retracted position out of contact with the internal wall of the tubular once a cut has been performed, the rotary cutting head being coupled to the remainder of the tubular cutting tool by one or more linking pins designed to break under a shearing or tensional force;

a second electrically powered or controlled actuator mounted in the housing and coupled to the retractable cutting blade for progressively advancing the cutting blade from the initial retracted position out of contact with the internal wall of the tubular towards the internal wall of the tubular and for subsequently retracting the cutting blade back to the retracted position out of contact with the internal wall of the tubular once a cut has been performed; and a third electrically powered or controlled actuator mounted in the housing and coupled to the rotary cutting head for rotating the rotary cutting head.

9. A tubular cutting tool for remotely cutting tubulars from the inside, comprising:

a housing;

two or more sets of retractable anchors mounted in the housing at longitudinally spaced apart locations, adapted to be advanced from an initial retracted position out of contact with the internal wall of a tubular to be cut to an anchoring position in contact with the internal wall of the tubular, such as to anchor the tubular cutting tool rigidly in position within the tubular, and to be subsequently retracted from the anchoring position back to the retracted position;

a first electrically powered or controlled actuator mounted in the housing and coupled to the retractable anchors for moving the retractable anchors from the retracted position to the anchoring position prior to performing a cut and then for moving the retractable anchors from the anchoring position back to the retracted position once a cut has been performed;

a rotary cutting head mounted on the housing, the rotary cutting head having a retractable cutting blade adapted to be progressively advanced from an initial retracted position out of contact with the internal wall of the tubular to a cutting position in contact with the internal wall of the tubular, and to be subsequently retracted from the cutting position back to the retracted position out of contact with the internal wall of the tubular once a cut has been performed;

a second electrically powered or controlled actuator mounted in the housing and coupled to the retractable cutting blade for progressively advancing the cutting blade from the initial retracted position out of contact with the internal wall of the tubular towards the internal wall of the tubular and for subsequently retracting the cutting blade back to the retracted position out of contact with the internal wall of the tubular once a cut has been performed;

a third electrically powered or controlled actuator mounted in the housing and coupled to the rotary cutting head for rotating the rotary cutting head; and internal workings which are filled with a pressurized fluid.

10. A tubular cutting tool according to claim 9, in which the fluid is pressurized by means of one or more floating pistons.

11. A tubular cutting tool according to claim 9 in which the fluid is an oil.

12. Apparatus for anchoring a tool within a tubular, comprising:

two or more sets of retractable anchoring means mounted on the tool at longitudinally spaced apart locations, adapted to be advanced from an initial retracted position out of contact with the internal wall of the tubular to an anchoring position in contact with the internal wall of the tubular, such as to anchor the tool rigidly in position within the tubular, and to be subsequently retracted from the anchoring position back to the retracted position;

electrically powered or controlled actuating means coupled to the retractable anchoring means for moving the retractable anchoring means from the retracted position to the anchoring position and then for moving the retractable anchoring means from the anchoring position back to the retracted position; and compensation means mounted on the tool between one or more of the sets of retractable anchoring means and the electrically powered or controlled actuating means for moving the retractable anchoring means, the compensation means including resilient means adapted to compensate for small variations in the internal radii of the tubular between two or more sets of the retractable anchoring means when in the anchoring position.

13. Apparatus for anchoring a tool within a tubular according to claim 12 wherein the sets of retractable anchoring means consist of two or more hinged legs, each made up of two leg sections connected by a hinge, the end of each leg section distant to the hinge being connected to a pivot on a mounting block, one of the mounting blocks being fixed relative to the remainder of the tool, the other being moveable longitudinally.

14. Apparatus for anchoring a tool within a tubular according to claim 12 wherein the resilient means is compressed as the retractable anchoring means are moved from the initial retracted position out of contact with the internal wall of the tubular to the anchoring position in contact with the internal wall of the tubular.

15. Apparatus for anchoring a tool within a tubular, comprising:

two or more sets of retractable anchors mounted on the tool at longitudinally spaced apart locations, adapted to be advanced from an initial retracted position out of contact with the internal wall of the tubular to an anchoring position in contact with the internal wall of the tubular, such as to anchor the tool rigidly in position within the tubular, and to be subsequently retracted from the anchoring position back to the retracted position;

an electrically powered or controlled actuator coupled to the retractable anchors for moving the retractable anchors from the retracted position to the anchoring position and for moving the retractable anchors from the anchoring position back to the retracted position; and one or more compensators mounted on the tool between one or more of the sets of retractable anchors and the electrically powered or controlled actuator for moving the retractable anchors, the compensator or compensators including a spring adapted to compensate for small variations in the internal radii of the tubular between two or more sets of the retractable anchors when in the anchoring position.

16. A tubular cutting tool for remotely cutting tubulars from the inside, comprising:

a housing;

two or more sets of retractable anchoring means mounted in the housing at longitudinally spaced apart locations, adapted to be advanced from an initial retracted position out of contact with the internal wall of a tubular to be cut to an anchoring position in contact with the internal wall of the tubular, such as to anchor the tubular cutting tool rigidly in position within the tubular, and to be subsequently retracted from the anchoring position back to the retracted position;

first electrically powered or controlled actuating means mounted in the housing and coupled to the retractable anchoring means for moving the retractable anchoring means from the retracted position to the anchoring position prior to performing a cut and then for moving the retractable anchoring means from the anchoring position back to the retracted position once a cut has been performed;

a rotary cutting head mounted on the housing, the rotary cutting head having a retractable cutting blade adapted to be progressively advanced from an initial retracted position out of contact with the internal wall of the tubular to a cutting position in contact with the internal wall of the tubular, and to be subsequently retracted from the cutting position back to the retracted position out of contact with the internal wall of the tubular once a cut has been performed;

second electrically powered or controlled actuating means mounted in the housing and coupled to the retractable cutting blade for progressively advancing the cutting blade from the initial retracted position out of contact with the internal wall of the tubular towards the internal wall of the tubular and for subsequently retracting the cutting blade back to the retracted position out of contact with the internal wall of the tubular once a cut has been performed;

third electrically powered or controlled actuating means mounted in the housing and coupled to the rotary cutting head for rotating the rotary cutting head; and a sole cable fixed to one end of the housing for deploying the tubular cutting tool within the tubular and for supplying electrical energy to power or control the first, second and third actuating means.

17. A tubular cutting tool for remotely cutting tubulars from the inside, comprising:

a housing;

two or more sets of retractable anchors mounted in the housing at longitudinally spaced apart locations, adapted to be advanced from an initial retracted position out of contact with the internal wall of a tubular to be cut to an anchoring position in contact with the internal wall of the tubular, such as to anchor the tubular cutting tool rigidly in position within the tubular, and to be subsequently retracted from the anchoring position back to the retracted position;

a first electrically powered or controlled actuator mounted in the housing and coupled to the retractable anchors for moving the retractable anchors from the retracted position to the anchoring position prior to performing a cut and then for moving the retractable anchors from the anchoring position back to the retracted position once a cut has been performed;

a rotary cutting head mounted on the housing, the rotary cutting head having a retractable cutting blade adapted to be progressively advanced from an initial retracted position out of contact with the internal wall of the tubular to a cutting position in contact with the internal wall of the tubular, and to be subsequently retracted from the cutting position back to the retracted position out of contact with the internal wall of the tubular once a cut has been performed;

a second electrically powered or controlled actuator mounted in the housing and coupled to the retractable cutting blade for progressively advancing the cutting blade from the initial retracted position out of contact with the internal wall of the tubular towards the internal wall of the tubular and for subsequently retracting the cutting blade back to the retracted position out of contact with the internal wall of the tubular once a cut has been performed;

a third electrically powered or controlled actuator mounted in the housing and coupled to the rotary cutting head for rotating the rotary cutting head; and a sole cable fixed to one end of the housing for deploying the tubular cutting tool within the tubular and for supplying electrical energy to power or control the first, second and third actuators.

18. A tubular cutting tool for remotely cutting tubulars from the inside, comprising:

a housing;

two or more sets of retractable anchors mounted in the housing at longitudinally spaced apart locations, adapted to be advanced from an initial retracted position out of contact with the internal wall of a tubular to be cut to an anchoring position in contact with the internal wall of the tubular, such as to anchor the tubular cutting tool rigidly in position within the tubular, and to be subsequently retracted from the anchoring position back to the retracted position;

a first electrically powered or controlled actuator mounted in the housing and coupled to the retractable anchors for moving the retractable anchors from the retracted position to the anchoring position prior to performing a cut and then for moving the retractable anchors from the anchoring position back to the retracted position once a cut has been performed, the first actuator including a screw shaft disposed within the housing, an electric motor disposed within the housing and drivingly coupled to the screw shaft to rotate same, and a carriage coupled to the retractable anchors and threadingly engaged with the screw shaft for longitudinal movement relative thereto within the housing, wherein rotation of the screw shaft in a first direction causes movement of the carriage in a first longitudinal direction to move the retractable anchors into the anchoring position, and rotation of the screw shaft in a second direction opposite the first direction causes movement of the carriage in a second longitudinal direction opposite the first longitudinal direction to move the retractable anchors into the retracted position;

a rotary cutting head mounted on the housing, the rotary cutting head having a retractable cutting blade adapted to be progressively advanced from an initial retracted position out of contact with the internal wall of the tubular to a cutting position in contact with the internal wall of the tubular, and to be subsequently retracted from the cutting position back to the retracted position out of contact with the internal wall of the tubular once a cut has been performed;

a second electrically powered or controlled actuator mounted in the housing and coupled to the retractable cutting blade for progressively advancing the cutting blade from the initial retracted position out of contact with the internal wall of the tubular towards the internal wall of the tubular and for subsequently retracting the cutting blade back to the retracted position out of contact with the internal wall of the tubular once a cut has been performed; and a third electrically powered or controlled actuator mounted in the housing and coupled to the rotary cutting head for rotating the rotary cutting head.

19. A tubular cutting tool according to claim 18, wherein the electric motor is a first electric motor, and the third actuator includes a second electric motor disposed within the housing and drivingly coupled to the rotary cutting head to rotate same, the second actuator including a gear arrangement mounted on the rotary cutting head for advancing and retracting the cutting blade through rotation of the rotary cutting head.

20. A tubular cutting tool according to claim 19, wherein each set of retractable anchors includes a plurality of hinged leg arrangements, each hinged leg arrangement including two leg sections connected to one another by a hinge, ends of the respective leg sections remote from the hinge being pivotably connected to respective mounting blocks, one of the mounting blocks being fixed and the other mounting block being longitudinally movable along the housing through movement of the carriage.

21. A tubular cutting tool for remotely cutting tubulars from the inside, comprising:

a housing;

two or more sets of retractable anchors mounted in the housing at longitudinally spaced apart locations, adapted to be advanced from an initial retracted position out of contact with the internal wall of a tubular to be cut to an anchoring position in contact with the internal wall of the tubular, such as to anchor the tubular cutting tool rigidly in position within the tubular, and to be subsequently retracted from the anchoring position back to the retracted position;

a first electrically powered or controlled actuator mounted in the housing and coupled to the retractable anchors for moving the retractable anchors from the retracted position to the anchoring position prior to performing a cut and then for moving the retractable anchors from the anchoring position back to the retracted position once a cut has been performed;

a rotary cutting head mounted on the housing, the rotary cutting head having a retractable cutting blade adapted to be progressively advanced, as the rotary cutting head rotates, from an initial retracted position out of contact with the internal wall of the tubular to a cutting position in contact with the internal wall of the tubular, and to be subsequently retracted, from the cutting position back to the retracted position out of contact with the internal wall of the tubular once a cut has been performed;

a second electrically powered or controlled actuator mounted in the housing and coupled to the retractable cutting blade for progressively advancing the cutting blade from the initial retracted position out of contact with the internal wall of the tubular towards the internal wall of the tubular and for subsequently retracting the cutting blade back to the retracted position out of contact with the internal wall of the tubular once a cut has been performed; and a third electrically powered or controlled actuator mounted in the housing and coupled to the rotary cutting head for rotating the rotary cutting head.

22. A tubular cutting tool for remotely cutting tubulars from the inside, comprising:

a housing;

two or more sets of retractable anchors mounted in the housing at longitudinally spaced apart locations, adapted to be advanced from an initial retracted position out of contact with the internal wall of a tubular to be cut to an anchoring position in contact with the internal wall of the tubular, such as to anchor the tubular cutting tool rigidly in position within the tubular, and to be subsequently retracted from the anchoring position back to the retracted position;

a first electrically powered or controlled actuator mounted in the housing and coupled to the retractable anchors for moving the retractable anchors from the retracted position to the anchoring position prior to performing a cut and then for moving the retractable anchors from the anchoring position back to the retracted position once a cut has been performed, the first actuator including a carriage coupled to the retractable anchors adapted for longitudinal movement relative to the housing, wherein movement of the carriage in a first longitudinal direction causes the retractable anchors to move into the anchoring position, and movement of the carriage in a second longitudinal direction opposite the first longitudinal direction causes the retractable anchors to move into the retracted position;

a rotary cutting head mounted on the housing, the rotary cutting head having a retractable cutting blade adapted to be progressively advanced from an initial retracted position out of contact with the internal wall of the tubular to a cutting position in contact with the internal wall of the tubular, and to be subsequently retracted from the cutting position back to the retracted position out of contact with the internal wall of the tubular once a cut has been performed;

a second electrically powered or controlled actuator mounted in the housing and coupled to the retractable cutting blade for progressively advancing the cutting blade from the initial retracted position out of contact with the internal wall of the tubular towards the internal wall of the tubular and for subsequently retracting the cutting blade back to the retracted position out of contact with the internal wall of the tubular once a cut has been performed; and a third electrically powered or controlled actuator mounted in the housing and coupled to the rotary cutting head for rotating the rotary cutting head.

23. A tubular cutting tool for remotely cutting tubulars from the inside, comprising:

a housing;

two or more sets of retractable anchoring means mounted in the housing at longitudinally spaced apart locations, adapted to be advanced from an initial retracted position out of contact with the internal wall of a tubular to be cut to an anchoring position in contact with the internal wall of the tubular, such as to anchor the tubular cutting tool rigidly in position within the tubular, and to be subsequently retracted from the anchoring position back to the retracted position;

first electrically powered or controlled actuating means mounted in the housing and coupled to the retractable anchoring means for moving the retractable anchoring means from the retracted position to the anchoring position prior to performing a cut and then for moving the retractable anchoring means from the anchoring position back to the retracted position once a cut has been performed;

a rotary cutting head mounted on the housing, the rotary cutting head having a retractable cutting blade adapted to be progressively advanced from an initial retracted position out of contact with the internal wall of the tubular to a cutting position in contact with the internal wall of the tubular, and to be subsequently retracted from the cutting position back to the retracted position out of contact with the internal wall of the tubular once a cut has been performed;

second electrically powered or controlled actuating means mounted in the housing and coupled to the retractable cutting blade for progressively advancing the cutting blade from the initial retracted position out of contact with the internal wall of the tubular towards the internal wall of the tubular and for subsequently retracting the cutting blade back to the retracted position out of contact with the internal wall of the tubular once a cut has been performed; and third electrically powered or controlled actuating means mounted in the housing and coupled to the rotary cutting head for rotating the rotary cutting head;

wherein the sets of retractable anchoring means include two or more hinged legs, each made up of two leg sections connected by a hinge, the end of each leg section distant to the hinge is connected to a pivot on a mounting block, one of the mounting blocks being fixed relative to the remainder of the tool, the other being moveable in the longitudinal direction.

24. A tubular cutting tool according to claim 23, wherein the hinge of each pair of hinged legs engages the internal wall of the tubular in the anchoring position.

25. A tubular cutting tool for remotely cutting tubulars from the inside, comprising:

a housing;

two or more sets of retractable anchoring means mounted in the housing at longitudinally spaced apart locations, adapted to be advanced from an initial retracted position out of contact with the internal wall of a tubular to be cut to an anchoring position in contact with the internal wall of the tubular, such as to anchor the tubular cutting tool rigidly in position within the tubular, and to be subsequently retracted from the anchoring position back to the retracted position;

first electrically powered or controlled actuating means mounted in the housing and coupled to the retractable anchoring means for moving the retractable anchoring means from the retracted position to the anchoring position prior to performing a cut and then for moving the retractable anchoring means from the anchoring position back to the retracted position once a cut has been performed;

an outer sleeve which is arranged to move longitudinally in order to advance and retract at least one set of retractable anchoring means, wherein when the at least one set of retractable anchoring means are retracted they are at least partially covered by the outer sleeve;

a rotary cutting head mounted on the housing, the rotary cutting head having a retractable cutting blade adapted to be progressively advanced from an initial retracted position out of contact with the internal wall of the tubular to a cutting position in contact with the internal wall of the tubular, and to be subsequently retracted from the cutting position back to the retracted position out of contact with the internal wall of the tubular once a cut has been performed;

second electrically powered or controlled actuating means mounted in the housing and coupled to the retractable cutting blade for progressively advancing the cutting blade from the initial retracted position out of contact with the internal wall of the tubular towards the internal wall of the tubular and for subsequently retracting the cutting blade back to the retracted position out of contact with the internal wall of the tubular once a cut has been performed; and third electrically powered or controlled actuating means mounted in the housing and coupled to the rotary cutting head for rotating the rotary cutting head.

26. A tubular cutting tool for remotely cutting tubulars from the inside, comprising:

a housing;

two or more sets of retractable anchoring means mounted in the housing at longitudinally spaced apart locations, adapted to be advanced from an initial retracted position out of contact with the internal wall of a tubular to be cut to an anchoring position in contact with the internal wall of the tubular, such as to anchor the tubular cutting tool rigidly in position within the tubular, and to be subsequently retracted from the anchoring position back to the retracted position;

first electrically powered or controlled actuating means mounted in the housing and coupled to the retractable anchoring means for moving the retractable anchoring means from the retracted position to the anchoring position prior to performing a cut and then for moving the retractable anchoring means from the anchoring position back to the retracted position once a cut has been performed;

a rotary cutting head mounted on the housing, the rotary cutting head having a retractable cutting blade adapted to be progressively advanced from an initial retracted position out of contact with the internal wall of the tubular to a cutting position in contact with the internal wall of the tubular, and to be subsequently retracted from the cutting position back to the retracted position out of contact with the internal wall of the tubular once a cut has been performed;

second electrically powered or controlled actuating means mounted in the housing and coupled to the retractable cutting blade for progressively advancing the cutting blade from the initial retracted position out of contact with the internal wall of the tubular towards the internal wall of the tubular and for subsequently retracting the cutting blade back to the retracted position out of contact with the internal wall of the tubular once a cut has been performed; and third electrically powered or controlled actuating means mounted in the housing and coupled to the rotary cutting head for rotating the rotary cutting head;

the tubular cutting tool being arranged such that pulling on the tool from above tends to force the anchoring means inwardly towards the retracted position.

27. A tubular cutting tool for remotely cutting tubulars from the inside, comprising:

a housing;

two or more sets of retractable anchoring means mounted in the housing at longitudinally spaced apart locations, adapted to be advanced from an initial retracted position out of contact with the internal wall of a tubular to be cut to an anchoring position in contact with the internal wall of the tubular, such as to anchor the tubular cutting tool rigidly in position within the tubular, and to be subsequently retracted from the anchoring position back to the retracted position;

first electrically powered or controlled actuating means mounted in the housing and coupled to the retractable anchoring means for moving the retractable anchoring means from the retracted position to the anchoring position prior to performing a cut and then for moving the retractable anchoring means from the anchoring position back to the retracted position once a cut has been performed;

a rotary cutting head mounted on the housing, the rotary cutting head having a retractable cutting blade adapted to be progressively advanced from an initial retracted position out of contact with the internal wall of the tubular to a cutting position in contact with the internal wall of the tubular, and to be subsequently retracted from the cutting position back to the retracted position out of contact with the internal wall of the tubular once a cut has been performed;

second electrically powered or controlled actuating means mounted in the housing and coupled to the retractable cutting blade for progressively advancing the cutting blade from the initial retracted position out of contact with the internal wall of the tubular towards the internal wall of the tubular and for subsequently retracting the cutting blade back to the retracted position out of contact with the internal wall of the tubular once a cut has been performed; and third electrically powered or controlled actuating means mounted in the housing and coupled to the rotary cutting head for rotating the rotary cutting head;

the tubular cutting tool being arranged such that the surfaces of the sets of retractable anchoring means, which contact the internal wall of the tubular in the anchoring position, are cam shaped in the direction tangential to the tool such that torque generated in the tool tends to increase the radial force exerted by the retractable anchoring means on the internal wall of the tubular.

28. A tubular cutting tool for remotely cutting tubulars from the inside, comprising:

a housing;

two or more sets of retractable anchoring means mounted in the housing at longitudinally spaced apart locations, adapted to be advanced from an initial retracted position out of contact with the internal wall of a tubular to be cut to an anchoring position in contact with the internal wall of the tubular, such as to anchor the tubular cutting tool rigidly in position within the tubular, and to be subsequently retracted from the anchoring position back to the retracted position;

first electrically powered or controlled actuating means mounted in the housing and coupled to the retractable anchoring means for moving the retractable anchoring means from the retracted position to the anchoring position prior to performing a cut and then for moving the retractable anchoring means from the anchoring position back to the retracted position once a cut has been performed;

a rotary cutting head mounted on the housing, the rotary cutting head having a retractable cutting blade adapted to be progressively advanced from an initial retracted position out of contact with the internal wall of the tubular to a cutting position in contact with the internal wall of the tubular, and to be subsequently retracted from the cutting position back to the retracted position out of contact with the internal wall of the tubular once a cut has been performed;

second electrically powered or controlled actuating means mounted in the housing and coupled to the retractable cutting blade for progressively advancing the cutting blade from the initial retracted position out of contact with the internal wall of the tubular towards the internal wall of the tubular and for subsequently retracting the cutting blade back to the retracted position out of contact with the internal wall of the tubular once a cut has been performed; and third electrically powered or controlled actuating means mounted in the housing and coupled to the rotary cutting head for rotating the rotary cutting head;

the tubular cutting tool being arranged such that, if sufficient tensioning force is applied to the top of the tool to shear weakened linking pins in the tool, the shearing of the linking pins can cause the retractable anchoring means to collapse.

* * * * *